US008879963B2

(12) United States Patent
Hirayama et al.

(10) Patent No.: US 8,879,963 B2
(45) Date of Patent: Nov. 4, 2014

(54) TONER SUPPLYING DEVICE AND IMAGE FORMING APPARATUS USING SAME

(75) Inventors: Yushi Hirayama, Sagamihara (JP); Eichi Koizumi, Ebina (JP); Hitoshi Ishibashi, Kamakura (JP); Tetsuya Muto, Kawasaki (JP)

(73) Assignee: Ricoh Company, Limited, Tokyo (JP)

( * ) Notice: Subject to any disclaimer, the term of this patent is extended or adjusted under 35 U.S.C. 154(b) by 614 days.

(21) Appl. No.: 12/907,576

(22) Filed: Oct. 19, 2010

(65) Prior Publication Data

US 2011/0110689 A1 May 12, 2011

(30) Foreign Application Priority Data

Nov. 6, 2009 (JP) ..... 2009-254564
Nov. 16, 2009 (JP) ..... 2009-260856

(51) Int. Cl.
*G03G 15/08* (2006.01)
*G03G 15/01* (2006.01)

(52) U.S. Cl.
CPC ..... *G03G 15/0834* (2013.01); *G03G 15/0896* (2013.01)
USPC ..... 399/258; 399/53; 399/224; 399/255

(58) Field of Classification Search
USPC ..... 399/53, 119, 120, 224, 255, 256, 258, 399/259, 260, 262
See application file for complete search history.

(56) References Cited

U.S. PATENT DOCUMENTS 7,139,511 B2 11/2006 Ishibashi
7,305,195 B2 12/2007 Ishibashi
7,398,026 B2 7/2008 Ishibashi
7,493,058 B2 2/2009 Takeuchi et al.
7,526,219 B2 4/2009 Ishibashi
7,536,121 B2 5/2009 Shimizu et al.
7,546,046 B2 6/2009 Ishibashi
7,551,862 B2 6/2009 Tanaka et al.
7,603,046 B2 10/2009 Hirayama
7,747,182 B2 6/2010 Kato et al.
7,773,899 B2 8/2010 Ishibashi
7,787,784 B2 8/2010 Hori
2004/0047642 A1* 3/2004 Kosuge ..... 399/53
2006/0083553 A1* 4/2006 Makino ..... 399/258

(Continued)

FOREIGN PATENT DOCUMENTS

JP 2005-91715 4/2005
JP 3917761 2/2007

(Continued)

*Primary Examiner* — Joseph S Wong

(74) *Attorney, Agent, or Firm* — Oblon, Spivak, McClelland, Maier & Neustadt, L.L.P.

(57) ABSTRACT

A toner supplying device including a secondary toner container, a first feeding member performing a first feeding operation of feeding toner from a toner container to the secondary container on demand, a second feeding member performing a second feeding operation of feeding the toner from the secondary container to a developing device on demand, and a toner supply controller controlling the amount of the toner in the secondary container to be greater than a predetermined amount. The controller performs first control in which when the first feeding operation is performed, the amount of the toner fed in the second feeding operation per unit of time is decreased, or second control in which when the amount of the toner fed in the second feeding operation is greater than a predetermined amount, the amount of the toner fed in the first feeding operation per unit of time is decreased.

16 Claims, 13 Drawing Sheets

(56) References Cited

U.S. PATENT DOCUMENTS

| | | | | |
|---|---|---|---|---|
| 2008/0181670 | A1 | 7/2008 | Tsuda et al. | |
| 2008/0273885 | A1 | 11/2008 | Koizumi et al. | |
| 2009/0180813 | A1* | 7/2009 | Yoneda et al. | 399/258 |
| 2009/0190960 | A1 | 7/2009 | Hirayama et al. | |
| 2009/0279907 | A1 | 11/2009 | Tanaka et al. | |

FOREIGN PATENT DOCUMENTS

| | | |
|---|---|---|
| JP | 3947625 | 4/2007 |
| JP | 4006215 | 8/2007 |
| JP | 2008-33090 | 2/2008 |
| JP | 2008-299315 | 12/2008 |

* cited by examiner

TONER SUPPLYING DEVICE AND IMAGE FORMING APPARATUS USING SAME

BACKGROUND OF THE INVENTION

1. Field of the Invention

The present invention relates to a toner supplying device for supplying a toner to a developing device of an image forming apparatus, and to an image forming apparatus having the toner supplying device.

2. Description of the Related Art

Electrophotographic image forming apparatuses such as copiers and laser printers form an image by performing the following processes:

(1) forming an electrostatic latent image on an image bearing member;

(2) developing the electrostatic latent image using a developing device to form an unfixed toner image on the image bearing member;

(3) transferring the unfixed toner image onto a recording material (such as paper sheets); and (4) fixing the toner image to the recording material using a fixing device.

A key component is the developing device, and a toner supplying device for supplying a toner to the developing device is typically provided in such image forming apparatuses.

As one example of the toner supplying device, there is a toner supplying device having a sub-hopper, which is provided between a toner container and a developing device to temporarily contain a toner to be supplied to the developing device. The sub-hopper has an internal partition for separating the sub-hopper vertically into upper and lower chambers, a powder pump for transporting the toner from the toner container to the upper chamber of the sub-hopper, a toner circulating device (i.e., an upper screw) for circulating the toner in the upper chamber, and a lower screw provided in the lower chamber for supplying the toner to the developing device. Further, the toner supplying device has a rib for preventing occurrence of a toner influx in which the toner, which is transported from the toner container to the upper chamber, is fed to the developing device without being circulated in the upper chamber, and a controller for controlling supply of the toner such that, when the powder pump is operated to transport the toner from the toner container to the sub-hopper, the lower screw is not operated to prevent occurrence of the toner influx.

Specifically, the mechanism of the toner influx occurring in such a toner supplying device is an increase in pressure in the sub-hopper as the toner is supplied from the toner container by the powder pump, particularly when the upper and lower screws are operated while the powder pump is operated, thereby feeding excess amounts of toner to the developing device. By performing control such that the toner feeding operation performed by the upper and lower screws in the sub-hopper is not performed when the powder pump is operated, increase in pressure of the sub-hopper is avoided, thereby preventing occurrence of the toner influx.

As another example of the toner supplying device, a toner supplying device controlling the concentration of toner in a developer by estimating the toner concentration based on the toner concentration measured on an upstream side therefrom relative to the developer circulating direction is known. Specifically, in the toner supplying device, a toner supplying member is driven by a driving source to feed a toner supplied from a predetermined supply point to a developing roller while measuring concentration of the toner in a developer passing through a first point upstream from the supply point relative to the developer circulating direction. In addition, change of the toner concentration in the developer passing a second point located downstream from the supply point and upstream from the developing roller is estimated to control the toner concentration by controlling power supply from the driving source on the order of several hundreds of milliseconds based on the estimated toner concentration.

On the other hand, image forming apparatuses are often needed to perform a repeat imaging operation in which the same image having a high image area ratio is repeatedly formed continuously on consecutive recording sheets. In this case, a toner supplying operation (i.e., a feeding screw driving operation) has to be performed on a high duty. In this regard, it is likely that the image density of produced images decrease if toner supply control is not satisfactorily performed.

For these reasons, there is a need for a toner supplying device which can reliably supply toner to a developing device without causing the toner influx and without forming low-density images in a repeat imaging operation.

SUMMARY

This patent specification describes a novel toner supplying device for supplying a toner from a toner container to a developing device, one embodiment of which includes a secondary toner container disposed between the toner container and the developing device to temporarily store the toner; a first feeding member configured to perform a first toner feeding operation of feeding the toner from the toner container to the secondary toner container on demand; a second feeding member configured to perform a second toner feeding operation of feeding the toner from the secondary toner container to the developing device on demand; and a toner supply controller configured to control the first and second toner feeding operations so that an amount of the toner in the secondary toner container be greater than a predetermined amount. The toner supplying controller performs a control operation in which when the first toner feeding operation is performed, an amount of the toner fed in the second toner feeding operation per unit of time is relatively decreased compared to a case in which the first toner feeding operation is not performed. Alternatively, the toner supplying controller performs another control operation in which when the amount of the toner fed in the second toner feeding operation is greater than a predetermined amount, an amount of the toner fed in the first toner feeding operation per unit of time is relatively decreased compared to a case in which the amount of the toner fed in the second toner feeding operation is not greater than the predetermined amount.

This patent specification further describes a novel image forming apparatus, one embodiment of which includes an image bearing member configured to bear an electrostatic latent image; a developing device configured to develop the electrostatic latent image with a developer including a toner; a toner container configured to contain the toner; and the above-mentioned toner supplying device configured to supply the toner from the toner container to the developing device.

BRIEF DESCRIPTION OF THE DRAWINGS

A more complete appreciation of aspects of the invention and many of the attendant advantage thereof will be readily obtained as the same become better understood by reference to the following detailed description when considered in connection with the accompanying drawings, wherein.

DESCRIPTION OF THE PREFERRED EMBODIMENTS

Figure 1:
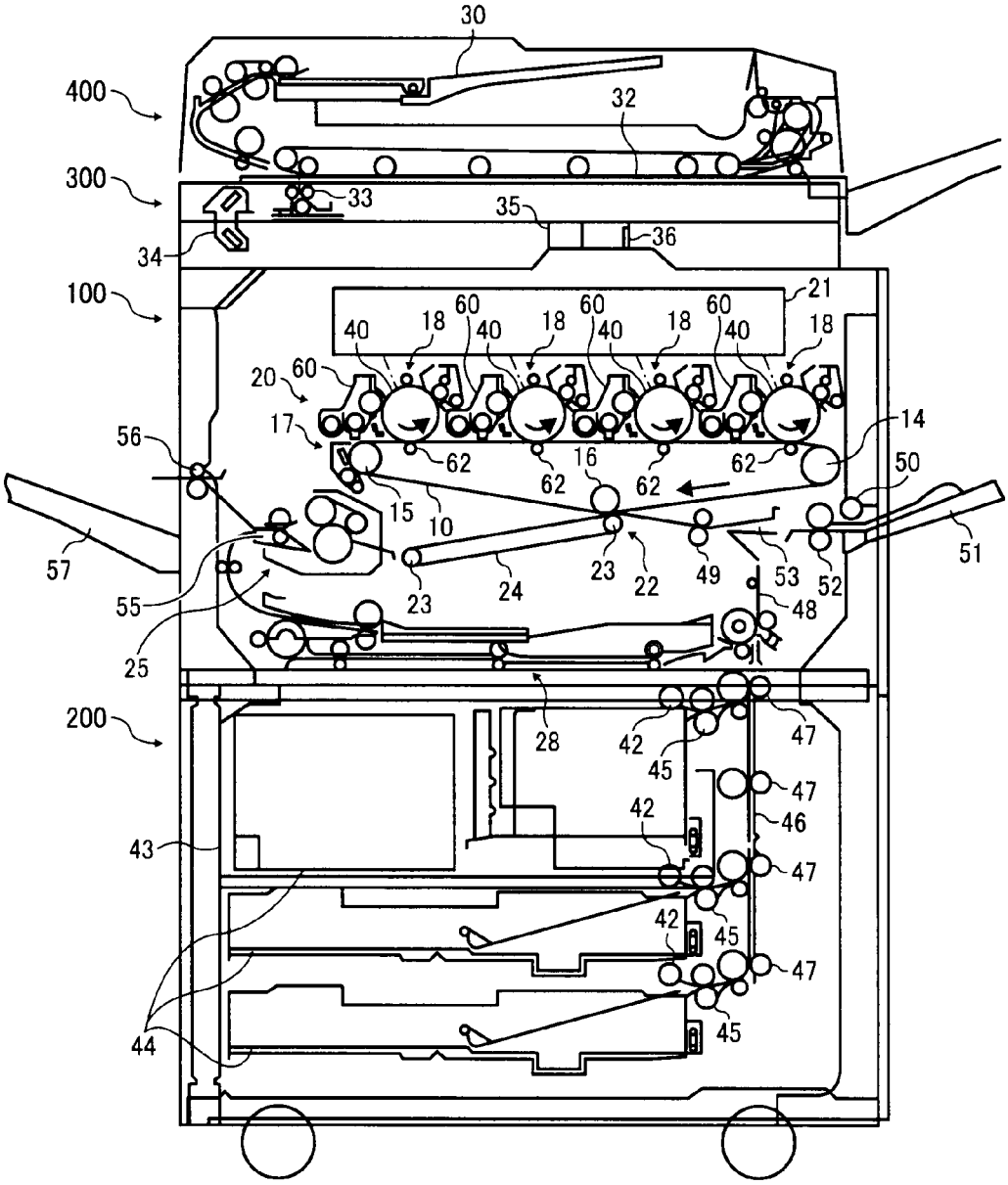
FIG. 1 is a schematic view illustrating a full-color copier as one embodiment of the image forming apparatus of the present invention.

FIG. 1 illustrates a tandem full-color image forming apparatus as an example of the image forming apparatus of the present invention having the toner supplying device of the present invention.

The image forming apparatus illustrated in FIG. 1 includes a main body 100 thereof, a sheet feeding section 200 located below the main body, a scanner 300 located above the main body, and an automatic document feeder 400 located above the scanner.

In a center of the main body 100, an intermediate transfer belt 10 including a flexible endless belt and tightly stretched across multiple rollers 14, 15 and 16 is provided. One of the rollers is rotated by a driving device (not shown) to rotate the intermediate transfer belt 10 in a direction indicated by an arrow, and the other rollers are rotated by the thus-rotated intermediate transfer belt. In addition, the main body 100 includes a tandem image forming section 20 including four image forming units 18 configured to respectively form black, cyan, magenta and yellow images and arranged side by side along the upper flat portion of the intermediate transfer belt 10 supported by the rollers 14 and 15.

Each of the four image forming units 18 has a photoreceptor drum 40 contacted with the intermediate transfer belt 10, and a charger, a developing device 60, a cleaner, a discharger, etc., are provided around the photoreceptor drum. In addition, primary transfer members 62 are provided so as to face the photoreceptor drums 40 with the intermediate transfer belt therebetween. In this embodiment of the image forming apparatus, the four image forming units 18 have the same configuration, but the color of the toner used for the developer of the developing device is different so that the image forming units produce different color images (i.e., black, cyan, magenta and yellow color images). In addition, an irradiating device 21 is provided above the image forming units 18 to irradiate the surface of each of the photoreceptor drums 40 with a laser beam (illustrated by a chain line) modulated by image information through a space between a charger and the developing device 60. In this regard, four irradiating devices may be provided for the respective image forming units 18, but it is preferable to use a single irradiating device for the four image forming units to reduce the cost of the irradiating device 21.

A secondary transfer device 22 is provided on the opposite side of the tandem image forming section 20 relative to the intermediate transfer belt 10. The secondary transfer device 22 includes an endless secondary transfer belt 24, which is tightly stretched across two rollers 23 and 23 and which is pressed toward the roller 16 so as to be contacted with the roller with the intermediate transfer belt 10 therebetween.

Further, a fixing device 25 configured to fix a toner image formed on a recording sheet is provided on the left side of the secondary transfer device 22. The fixing device 25 has a pressing roller, and an endless fixing belt supported by two rollers so as to be pressed toward the pressing roller.

The secondary transfer device 22 also has a function of feeding a recording sheet (such as a paper sheet or a film sheet) bearing a toner image thereon to the fixing device 25. A non-contact charger may be used as the secondary transfer device 22 instead of such an endless belt. In such a case, it is necessary for the secondary transfer device to have a sheet feeding member configured to feed a recording sheet to the fixing device 25.

Further, a sheet reversing device 28 is provided below the secondary transfer device 22 and the fixing device 25 so as to be parallel to the tandem image forming section 20 to reverse a recording sheet bearing a fixed toner image on one side thereof and to produce a duplex copy.

Next, a full-color image forming operation of the tandem color image forming apparatus will be explained.

An original to be copied is set on a table 30 of the automatic document feeder 400. Alternatively, the original may be directly set on a glass plate 32 of the scanner 300 after the automatic document feeder 400 is opened, followed by closing the automatic document feeder 400 to press the original to the glass plate.

When a start button (not shown) is pushed, the color image of the original set on the glass plate 32 is scanned with a first traveler 33 and a second traveler 34, which move in the right direction in FIG. 1, to be read. In the case in which the original is set on the table 30 of the automatic document feeder 400, the original is initially fed toward the glass plate 32, and then the color image thereon is scanned with the first and second travelers 33 and 34 to be read. The first traveler 33 irradiates the color image on the original with light and the second traveler 34 reflects the light reflected from the color image to send the color light image to a sensor 36 via a focusing lens 35. Thus, color image information (i.e., black, yellow, magenta and cyan color image data) of the original is obtained.

Meanwhile, the intermediate transfer belt 10 starts to rotate and the photoreceptor drums 40 also start to rotate. The irradiating device 21 irradiates the photoreceptors 40, which has been charged by a charger, with laser beams modulated so as to respectively include the black, yellow, magenta and cyan color image data of the original image to form electrostatic latent images corresponding to the black, yellow, magenta and cyan color images on the respective photoreceptor drums. The developing devices 60 develop the respective electrostatic latent images with developers including black, yellow, magenta and cyan toners to form black, yellow, magenta and cyan toner images on the respective photoreceptor drums 40. The thus-formed black, yellow, magenta and cyan toner images are sequentially transferred onto the intermediate transfer belt 10, resulting in formation of a combined multiple color toner image on the intermediate transfer belt.

Meanwhile, one of sheet feeding rollers 42 of the a sheet feeding section 200 is selectively rotated to feed a recording sheet from one of multiple sheet cassettes 44, which are arranged in a sheet bank 43 so as to be overlaid, toward a feeding passage 46. The recording sheet is then fed to a passage 48 by multiple feeding rollers 47, and is stopped by a pair of registration rollers 49 when the tip of the sheet strikes the registration rollers.

When manual sheet feeding is selected, a sheet feeding roller 50 is rotated to feed a recording sheet from a manual sheet tray 51 to a separation roller 52 so that the recording sheet is fed to the pair of registration rollers 49 while separated from other sheets on the manual sheet tray.

Next, the pair of registration rollers 49 is timely rotated to feed the recording sheet to a nip formed by the intermediate transfer belt 10 and the secondary transfer device 22 so that the combined color toner image on the intermediate transfer belt is transferred onto a proper position of the recording sheet at the nip.

The recording sheet bearing the combined color toner image thereon is then fed to the fixing device 25 by the secondary transfer device 22 so that the combined color toner image is fixed on the recording sheet upon application of heat and pressure, resulting in formation of a full-color image on the recording sheet. The recording sheet bearing a fixed full-color image thereon is then discharged from the main body 100 by a discharge roller 56 while the sheet path is properly selected by a paper path changing pick 55, resulting in stacking of a copy on a copy tray 57. When a duplex copy is produced, the paper path changing pick 55 is switched so that the recording sheet bearing a fixed image on one side thereof is fed to the sheet reversing device 28 to be reversed. The thus-reversed recording sheet is then fed to the second transfer device 22 through the passage 48 so that a second combined color toner image formed on the intermediate transfer belt 10 is transferred to the other side of the recording sheet by the secondary transfer device. The second combined color toner image formed on the other side is also fixed by the fixing device 25 and the duplex copy is then discharged to the copy tray 57 by the discharge roller 56.

After a secondary image transfer operation, the surface of the intermediate transfer device is cleaned by an intermediate transfer belt cleaner 17 to remove residual toner remaining thereon so that the intermediate transfer belt 10 is ready for the next secondary transfer operation.

Figure 2:
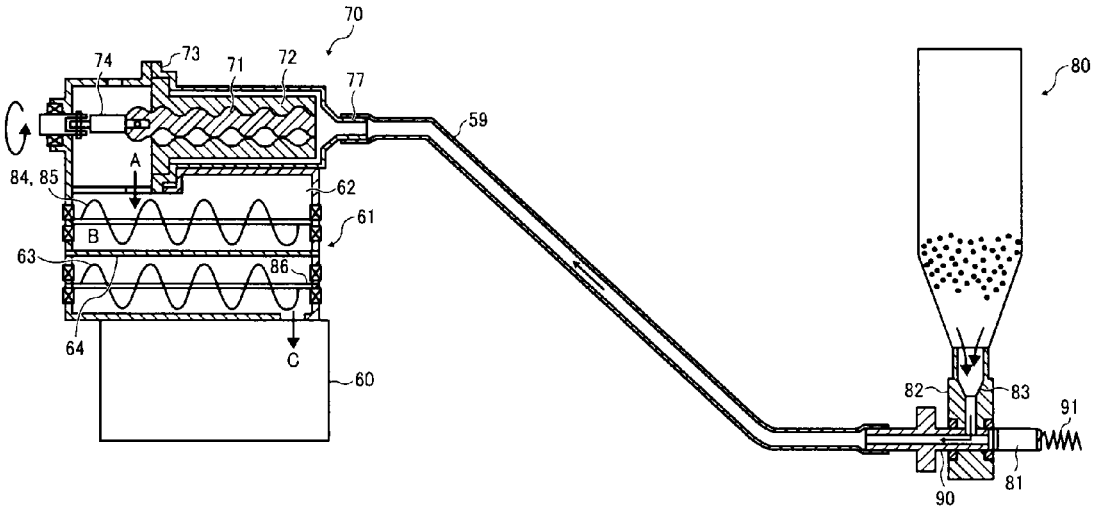
FIG. 2 is a schematic view illustrating an embodiment of the toner supplying device of the present invention.

FIG. 2 illustrates an embodiment of the toner supplying device of the present invention configured to supply a toner to the developing device 60.

Referring to FIG. 2, a toner container 80 containing a toner to be fed to the developing device 60 is set to an installation position (not shown in FIG. 1) of the main body 100 of the image forming apparatus, wherein a nozzle 90 is provided on the installation position to be inserted into a mouth of the toner container 80. When the toner container 80 is set to the installation position, a shutter 81 is retracted (i.e., to move to the right in FIG. 2), thereby inserting one end of the nozzle 90 into the toner container. The nozzle 90 has a single tube configuration, and a toner feeding tube 59 is connected to the other end of the nozzle.

The toner container 80 is a flexible deformable bag whose main body is made of a flexible sheet such as a polyester film, a polyethylene film, or a complex sheet consisting of multiple films, which has a thickness of from 80 μm to 125 μm. The toner container 80 has a mouth ring 82, which is made of a resin such as polyethylene and nylon and fixed to the mouth of the toner container and which has a toner discharging opening 83. The toner discharging opening 83 is generally closed by the shutter 81, but when the toner container 80 is set to the installation position, the shutter is pushed by the nozzle 90 so as to withdraw, thereby connecting the opening of the nozzle with the toner discharging opening 83. Reference numeral 91 denotes a spring for pressing the shutter 81 in such a direction as to return to the home position. When the toner container 80 is pulled out of the installation position, the spring 91 returns the shutter 81 to the home position, thereby closing the toner discharging opening 83 of the toner container.

As illustrated in FIG. 2, the toner supplying device has a secondary toner container 70, which is located above the developing device 60 and which feeds the toner from the toner container 80 to the developing device 60 through the toner feeding tube 59 while temporarily storing the toner therein.

The secondary toner container 70 has a sub-hopper 61 located above the developing device 60 to temporarily store the toner fed from the toner container 80, and a powder pump P located above the sub-hopper to feed the toner from the toner container to the sub-hopper.

The powder pump P is an eccentric single screw pump having a rotor 71 having an eccentric screw form and made of a rigid material such as a metal, a stator 72 having a double-threaded form and made of an elastic material such as a rubber, and a holder 73 covering the rotor and the stator while forming a toner passage and made of a material such as a resin.

The rotor 71 is connected with a driving shaft 74 using a pin joint, and the driving shaft is connected with a gear 75 (illustrated in FIG. 3), which is connected with a first clutch 76 via an idle gear (not shown). Therefore, the operation of the powder pump P can be controlled by engaging/disengaging the first clutch 76. In this regard, the first clutch 76 and a second clutch 68 mentioned below are provided on a rotation shaft 79 driven by a driving source (not shown).

The holder 73 has a toner suction opening 77 located on the right end of the holder and connected with the toner feeding tube 59. The toner feeding tube 59 is, for example, a flexible tube having a diameter of from 4 mm to 10 mm and made of a toner-resistant rubber such as polyurethane, nitrile, EPDM and silicone rubbers. Since the toner feeding tube 59 is flexible, the tube can be freely arranged.

Figure 6:
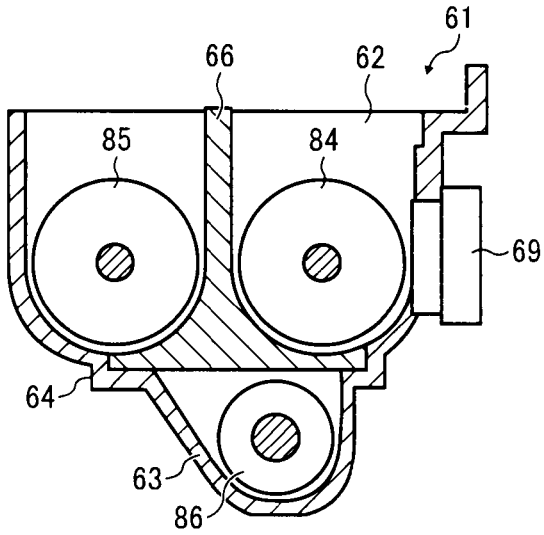
FIG. 6 is a vertical cross-section illustrating the sub-hopper of the secondary toner container illustrated in FIG. 3.

By using such a powder pump, the toner in the toner container 80 can be smoothly fed even when the toner discharging opening 83 of the toner container is located at a position lower in the vertical direction than that of the toner suction opening 77 of the secondary toner container 70. As illustrated in FIG. 6, the sub-hopper 61 has a form like an inverted triangle in a vertical sectional view, and is separated into an upper chamber 62 and a lower chamber 63 by a horizontal partition 64.

The upper chamber 62, which is larger in size than the lower chamber 63, has first and second upper screws 84 and 85, which are driven so as to rotate in opposite directions, and a vertical partition 66 (illustrated in FIG. 4) located between the first and second upper screws and having an opening at each of the end portions in the horizontal direction thereof. Although the vertical partition 66 and the horizontal partition 64 are constituted of one part in FIG. 6, the partitions may be constituted of separate parts.

Figure 4:
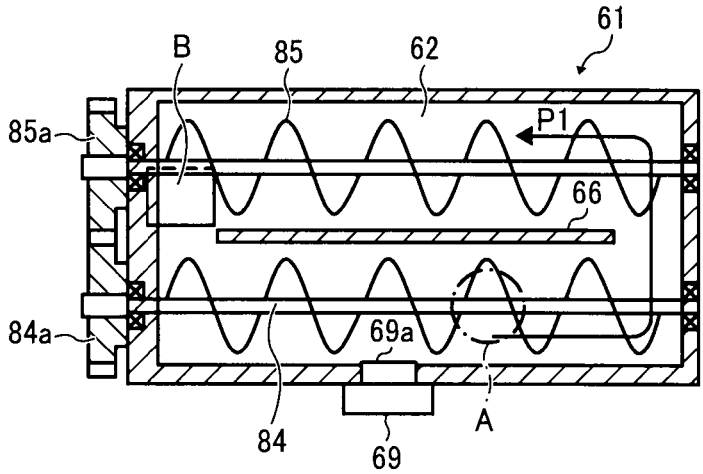
FIG. 4 is a transverse cross-section illustrating an upper chamber of a sub-hopper of the secondary toner container illustrated in FIG. 3.

Referring to FIGS. 2 and 4, the point of the upper chamber 62 indicated by reference character A is a toner supply point from which the toner is supplied to the upper chamber by the powder pump P. The toner thus supplied to the upper chamber 62 is circulated by the first and second screws 84 and 85 in a direction indicated by an arrow P1. In FIG. 4, reference character B denotes a connection hole connecting the upper chamber 62 with the lower chamber 63. The toner circulated by the first and second screws 84 and 85 is dropped into the lower chamber 63 through the connection hole B.

Figure 5:
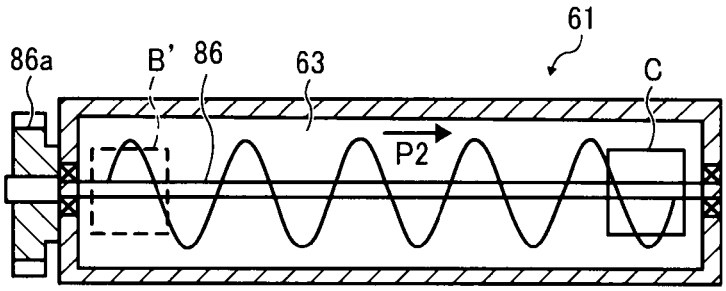
FIG. 5 is a transverse cross-section illustrating a lower chamber of the sub-hopper of the secondary toner container illustrated in FIG. 3.

As illustrated in FIG. 5, the lower chamber 63 has a lower screw 86 configured to rotate to feed the toner fed from the upper chamber 62 through the connection hole B (i.e., a position B') in a direction indicated by an arrow P2. In this regard, reference character C denotes a toner supply opening, and the toner fed in the direction indicated by the arrow P2 is dropped into the developing device 60 through the toner supply opening. Thus, the toner in the toner container 80 is supplied to the developing device 60.

Thus, the toner fed by the powder pump P to the secondary toner container 70 is temporarily stored therein and then fed to the developing device 60. Since gears 84*a*, 85*a* and 86*a* (illustrated in FIGS. 4 and 5) of the upper and lower screws 84, 85 and 86 are connected with a second clutch 68 provided on the rotation shaft 79 via an idle gear train, toner supply control mentioned below can be performed by engaging/disengaging the second clutch 68.

The amount of the toner fed by the first and second upper screws 84 and 85 is controlled so as to be larger than the amount of the toner fed by the lower screw 86, for example, by differentiating the diameters and/or rotation speeds of the upper screws 84 and 85 from those of the lower screw 86. Since the upper screws 84 and 85 and the lower screw 86 are rotated at the same time in this embodiment of the toner supplying device, the lower chamber 63 is generally filled with the toner. Therefore, when part of the toner in the lower chamber 63 is dropped into the developing device 60, part of the toner circulated in the upper chamber 62 in the direction P1 is dropped into the lower chamber 63 through the connection hole B to compensate for the toner dropped into the developing device from the lower chamber. In this regard, it is possible to control such that the upper screws 84 and 85 are driven separately from the lower screw 86.

Figure 3:
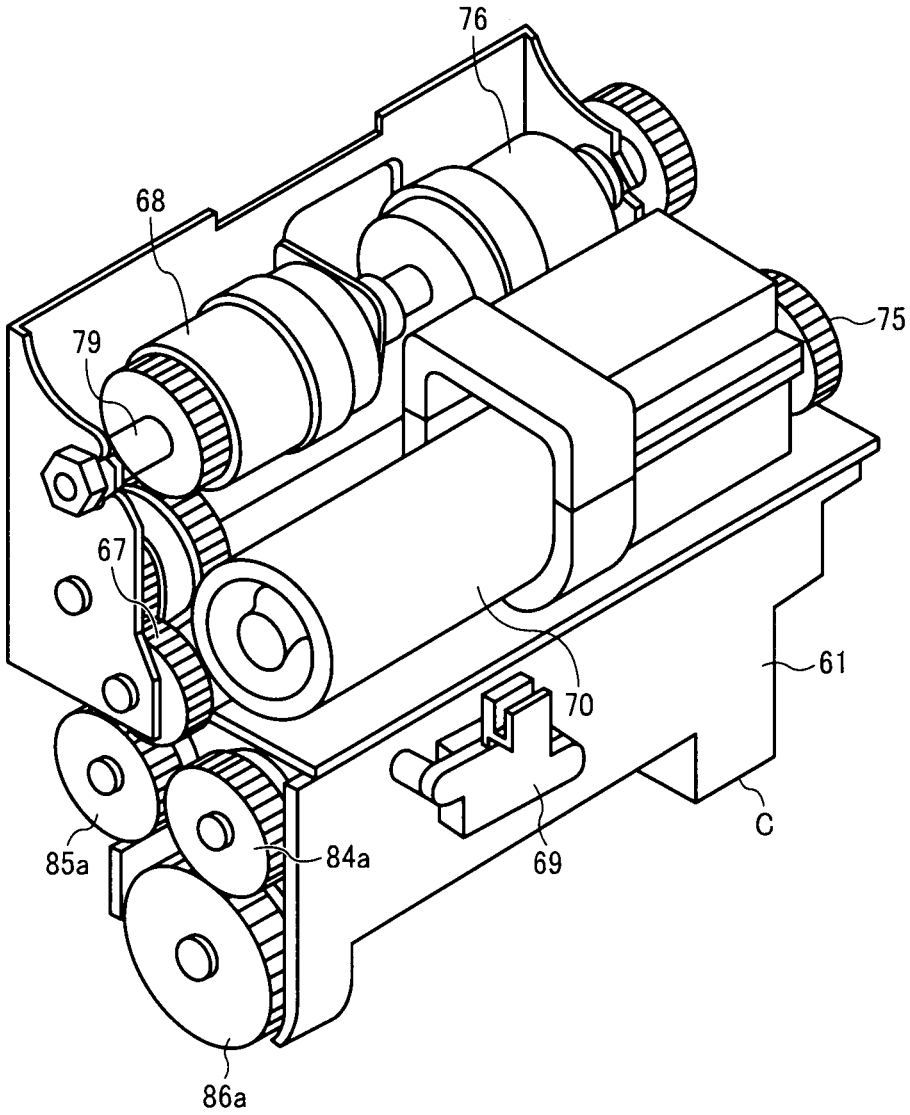
FIG. 3 is a perspective view illustrating a secondary toner container of the toner supplying device illustrated in FIG. 2.

Referring to FIGS. 3, 4 and 6, the secondary toner container 70 has a toner sensor 69 provided on a portion of the side wall of the sub-hopper 61 upstream from the toner supply point A relative to the toner circulating direction P1 to detect presence/absence of the toner in the upper chamber 62. In this embodiment, the toner sensor 69 is a vibration-type sensor and has a detection surface 69*a* contacted with the toner in the upper chamber 63 to detect presence/absence of the toner.

In this embodiment, the toner supplying device is constituted of the above-mentioned constituent members and a toner supply controller. In the toner supplying device having such a configuration, when supply of toner is ordered, the second clutch 68 is turned on (i.e., engaged) to rotate the first and second upper screws 84 and 85 and the lower screw 86. In this regard, a certain amount of toner in the lower chamber 63, which is determined by the rotation time of the lower screw 86, is supplied to the developing device 60. The amount of the toner in the upper chamber 62 is checked by the toner sensor 69, and when the upper surface of the toner layer in the upper chamber becomes lower than a predetermined level (i.e., the level of the detection position of the toner sensor), the powder pump P is operated to supply the toner in the toner container 80 to the sub-hopper 61. In this regard, it is not necessary to precisely control the amount of the toner supplied to the sub-hopper 61, and the amount of the toner supplied to the sub-hopper 61 by the powder pump P is controlled so as to be not less than the amount of the toner supplied to the developing device 60.

When the upper surface of the toner layer in the upper chamber 62 remains lower than the predetermined level even after the powder pump P is operated several times, the image forming apparatus judges that the toner in the toner container 80 is exhausted, i.e., a toner near-end state is achieved. When it is judged that a toner near-end state is achieved, a predetermined operation such that a message such as "The toner cartridge should be replaced with a new toner cartridge" is displayed in an operation panel (not shown) of the image forming apparatus is performed. In this case, after the image forming operation is performed a predetermined number of times, the image forming operation is stopped if the toner cartridge is not replaced. Even when the toner near-end is detected, a certain amount of toner is present in the sub-hopper 61, and therefore the toner concentration of the developer in the developing device does not decrease, resulting in prevention of formation of low-density images.

In order to reliably produce the effect described above, it is preferable to set the toner sensor 69 at a location close to and upstream from the toner supply point A to which the toner is supplied by the powder pump P. The reason therefor is as follows. Even when the amount of the toner at the toner sensor 69 is smaller than the predetermined amount, a maximal amount of toner can be stored in the sub-hopper 61 because the sub-hopper has a toner circulation passage such that the length from the toner supply point A to the connection hole B connecting the upper chamber 62 with the lower chamber 63 is longer than half of the length of the toner circulation passage in the sub-hopper in which the toner is circulated by the screws 84 and 85, thereby preventing the toner just supplied from the toner container 80 from being rapidly fed to the lower chamber 63. Therefore, even in a toner near-end state, the toner supply operation can be continued for a certain period of time, thereby reliably preventing formation of such low-density images as to be often formed by conventional developing devices in a toner near-end state.

Next, the operation of the toner supply controller in a repeat imaging operation will be described.

Figure 7:
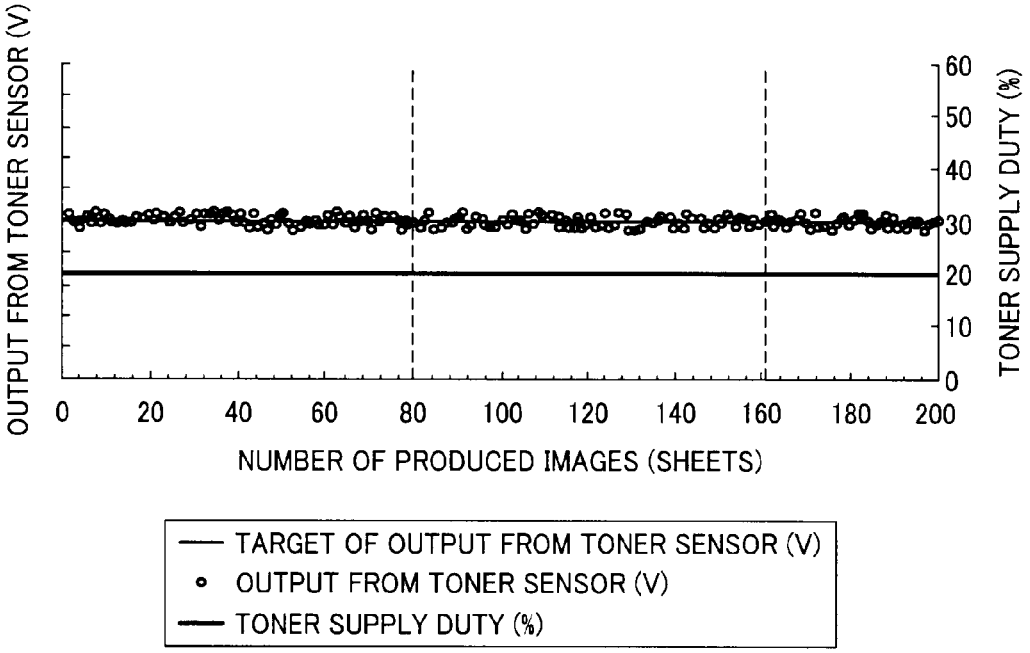
FIG. 7 is a graph illustrating a relation between the number of produced images and the output from a toner sensor when the toner supply duty is 20% and the toner supply control of the present invention is not performed.
Figure 8:
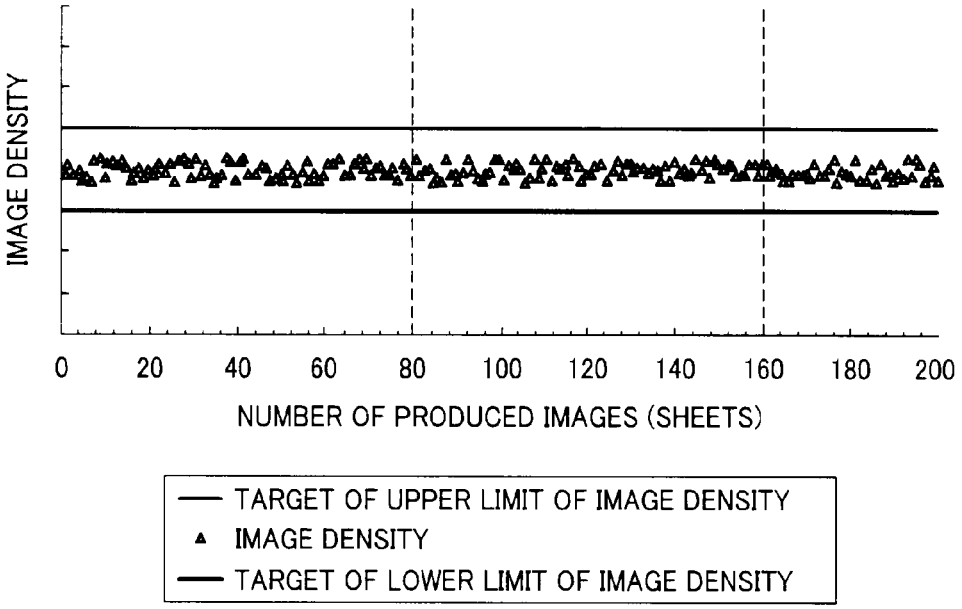
FIG. 8 is a graph illustrating change in image density of images in a repeat imaging operation when the toner supply duty is 20% and the toner supply control of the present invention is not performed.
Figure 13:
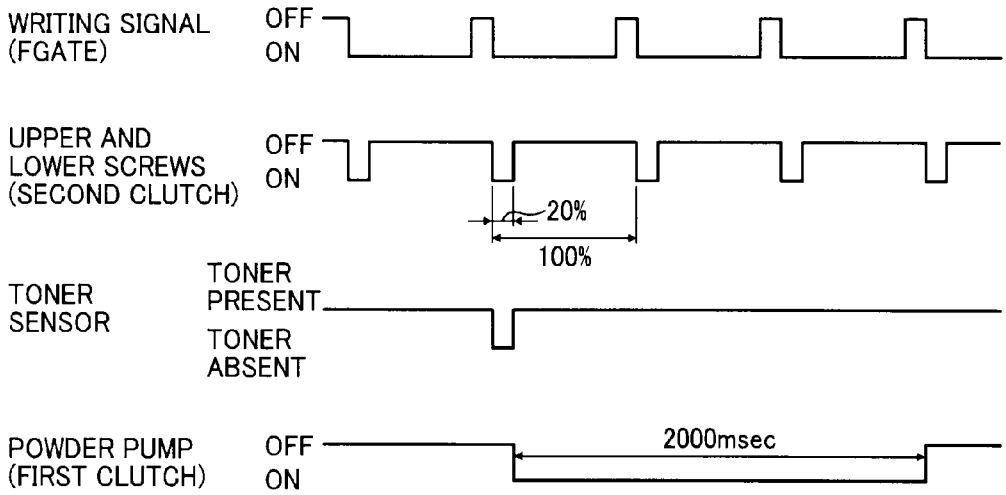
FIG. 13 is a timing chart illustrating an example of toner supply control of the present invention when the toner supply duty is 20%.

FIGS. 7, 8 and 13 relates to a toner supply control operation when the toner supply duty is 20% to maintain the image quality in a repeat imaging operation. In this regard, as illustrated in FIG. 13, the toner supply duty means the ratio of the operating time of the second clutch 68 to the period of time extending from a time at which a writing signal is output to a time at which the next writing signal is output.

The toner supply control timing illustrated in FIG. 13 is as follows. Specifically, it is assumed that in the second image forming operation in a repeat imaging operation, the toner sensor 69 provided on the sub-hopper 61 detects that no toner is present in the sub-hopper 61. According to the detection result, the toner supply controller controls such that the first clutch 76 is operated (i.e., engaged) for a predetermined time while driving the powder pump P to feed a predetermined amount of toner to the sub-hopper 61 at once. This toner supply operation is performed at times in which the $80^{th}$ image and the $160^{th}$ image are formed as illustrated by vertical broken lines in FIG. 7. It can be understood from FIGS. 7 and 8 that the output (illustrated by a circle mark in FIG. 7) from the toner sensor 69 varies around the target (illustrated by a horizontal solid line in FIG. 7) of the output of the toner sensor, and the image density (illustrated by a triangle mark in FIG. 8) of the produced images varies in a target range defined by two horizontal solid lines in FIG. 8. Thus, in the toner supply operation illustrated in FIG. 13, the toner influx is not caused if the toner supply duty is about 20%.

Figure 9:
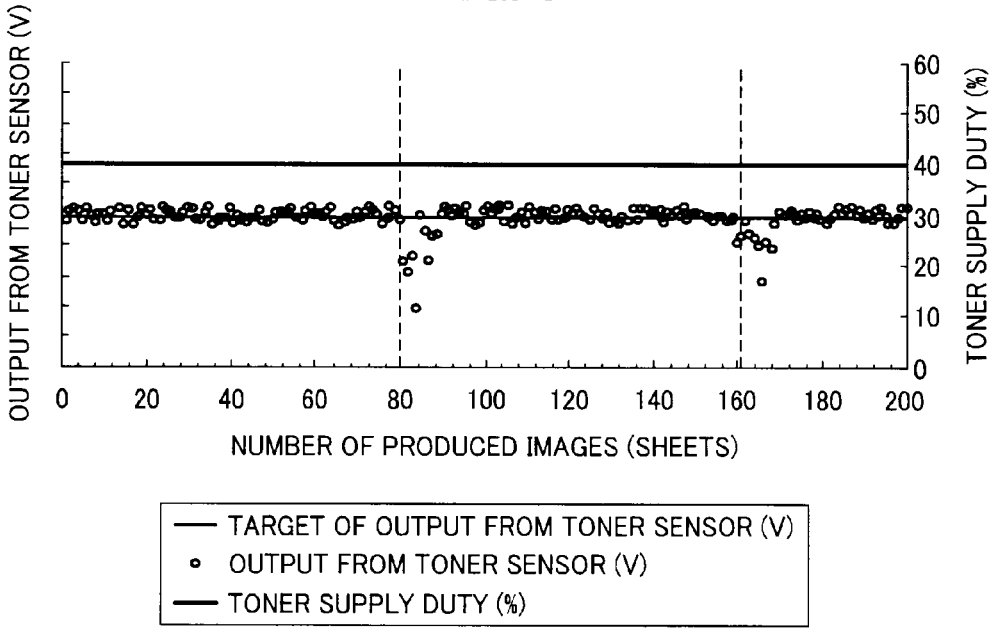
FIG. 9 is a graph illustrating a relation between the number of produced images and the output from a toner sensor when the toner supply duty is 40% and the toner supply control of the present invention is not performed.
Figure 10:
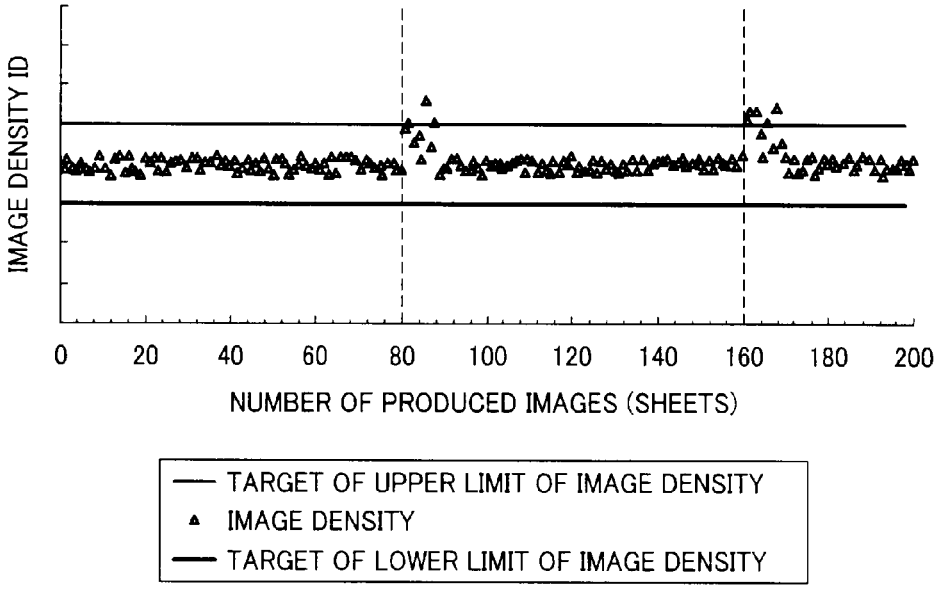
FIG. 10 is a graph illustrating change in image density of images in a repeat imaging operation when the toner supply duty is 40% and the toner supply control of the present invention is not performed.
Figure 14:
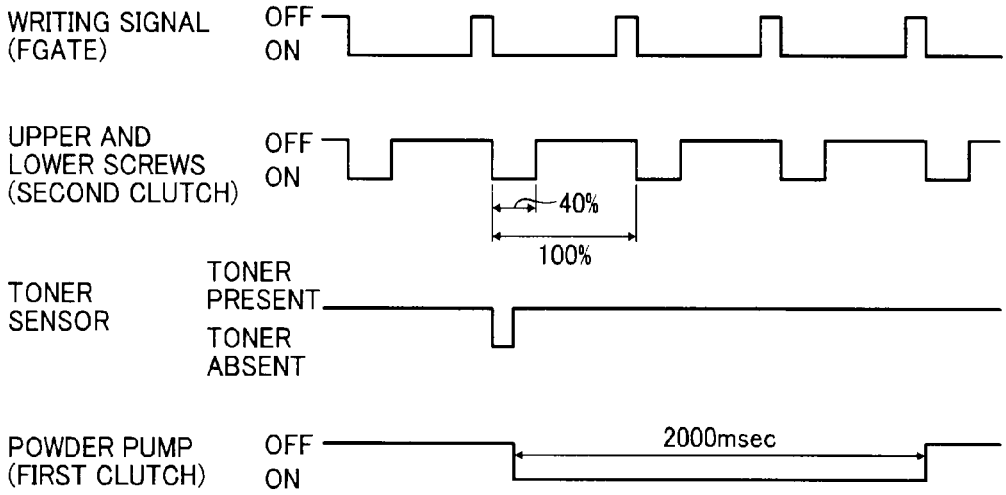
FIG. 14 is a timing chart illustrating a toner supply control other than the toner supply control of the present invention when the toner supply duty is 40%.

By contrast, FIGS. 9, 10, and 14 relates to another toner supply control operation when the toner supply duty is 40% to maintain the image quality in a repeat imaging operation repeatedly producing images with a high image area ratio. As illustrated in FIG. 14, the toner supply conditions are the same as those of the toner supply control operation illustrated in FIG. 13 except that the duty is changed from 20% to 40%. Similarly to the toner supply control operation illustrated in FIGS. 7, 8 and 13, the toner supplied at the times in which the $80^{th}$ image and the $160^{th}$ image are formed as illustrated by vertical broken lines in FIGS. 9 and 10. It can be understood from FIGS. 9 and 10 that the output (illustrated by a circle mark in FIG. 9) from the toner sensor largely decreases (i.e., the concentration of toner in the developer increases) right after the toner is supplied, and the image density (illustrated by a triangle mark in FIG. 10) of the produced images exceeds a target range defined by two horizontal solid lines in FIG. 10. Thus, in the toner supply control operation illustrated in FIG. 14, the toner influx is caused when the toner supply duty is not less than 40%.

When analyzing the results of the toner supply control operations illustrated in FIGS. 7-10 and 13-14, the problem to be solved is that in a repeat imaging operation repeatedly producing images with a high image area ratio, occurrence of the toner influx (i.e., increase in pressure in the sub-hopper 61) is prevented without changing the toner supply conditions to maintain the image density of the produced images. Therefore, the toner supplying device of the present invention performs a toner supply control operation in which when the amount of toner fed to a developing device is greater than a predetermined value (i.e., the toner supply duty is greater than 20%), the toner supply controller decreases toner feeding efficiency.

Figure 15:
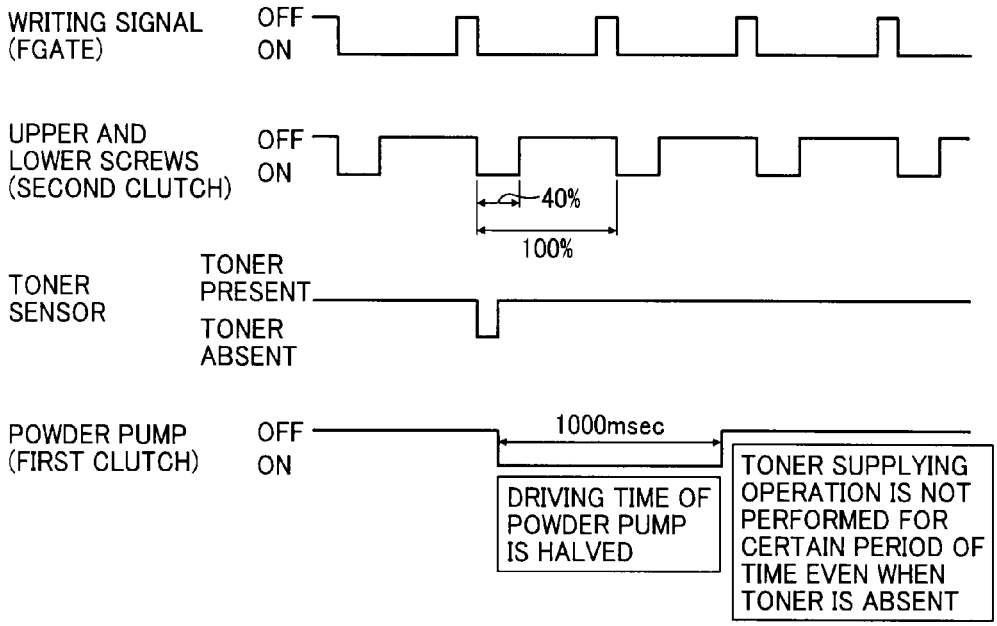
FIG. 15 is a timing chart illustrating an example of the toner supply control of the present invention when the toner supply duty is 40%.

FIG. 15 is a timing chart illustrating an example of the toner supply control of the present invention when the toner supply duty is 40%. In this case, the operating time of the powder pump P is changed so as to be half the operating time in the case illustrated in FIG. 14. Namely, the toner supply controller performs a toner supply control operation in which the period of one toner feeding operation of the pump of feeding the toner from the toner container 80 to the sub-hopper 61, is shortened.

Figure 11:
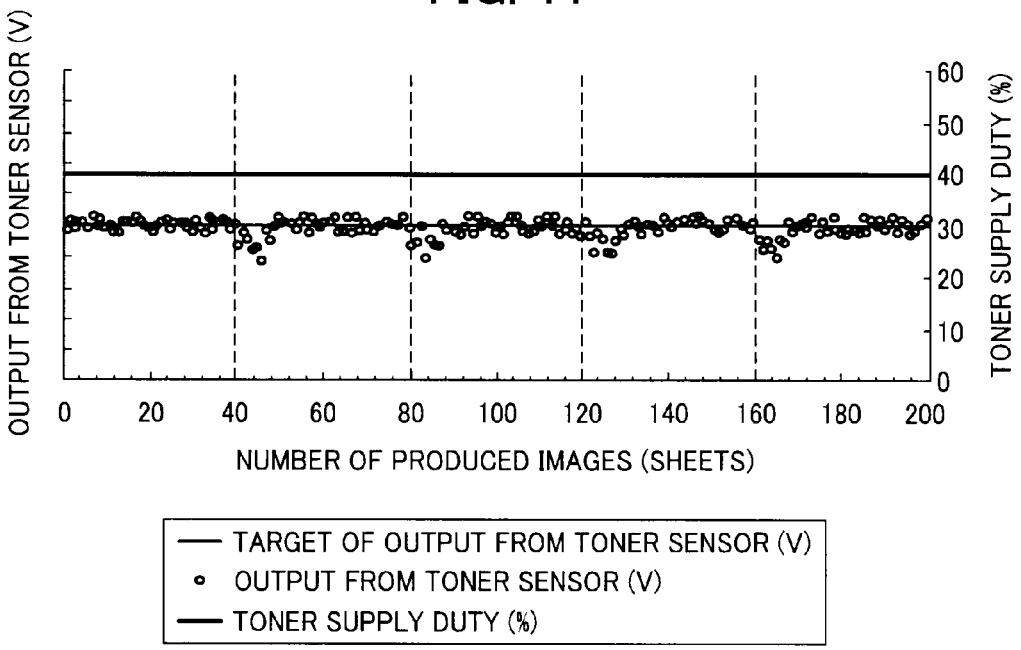
FIG. 11 is a graph illustrating a relation between the number of produced images and the output from a toner sensor when the toner supply duty is 40% and the toner supply control of the present invention is performed.
Figure 12:
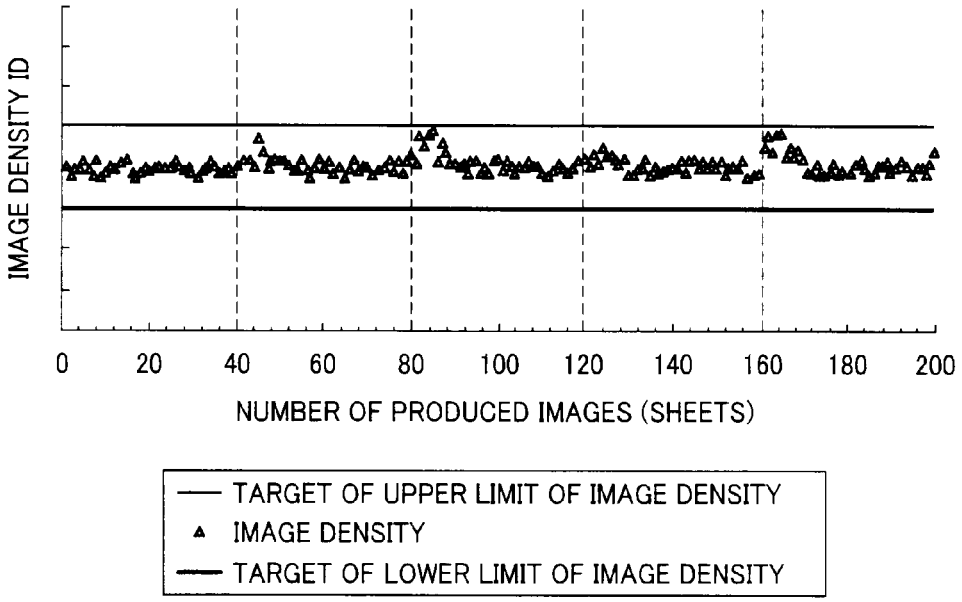
FIG. 12 is a graph illustrating change in image density of images in a repeat imaging operation when the toner supply duty is 40% and the toner supply control of the present invention is performed.

Since it is meaningless to continuously perform such a short toner supply operation, the toner supply controller performs a toner supply control operation in which, even if the toner sensor 69 detects that no toner is present in the sub-hopper 61 just after a toner supply operation is performed, the next toner supply operation is not performed for a predetermined time. The result of such a toner supply control is illustrated in FIGS. 11 and 12. Specifically, in this toner supply control operation, the toner supply operation is performed four times, i.e., at times in which the $40^{th}$, $80^{th}$, $120^{th}$ and $160^{th}$ images are produced, as illustrated by vertical broken lines in FIGS. 11 and 12. It is clear from FIGS. 11 and 12 that the decreasing rate of the output of the toner sensor can be decreased, and the image density of the produced images falls in the target range, even though the number of the toner supply operations performed is increased so as to be twice that in the case illustrated in FIG. 10. Thus, the toner supply control makes it possible to prevent increase in pressure in the sub-hopper 61, i.e., to prevent occurrence of the toner influx.

Figure 16:
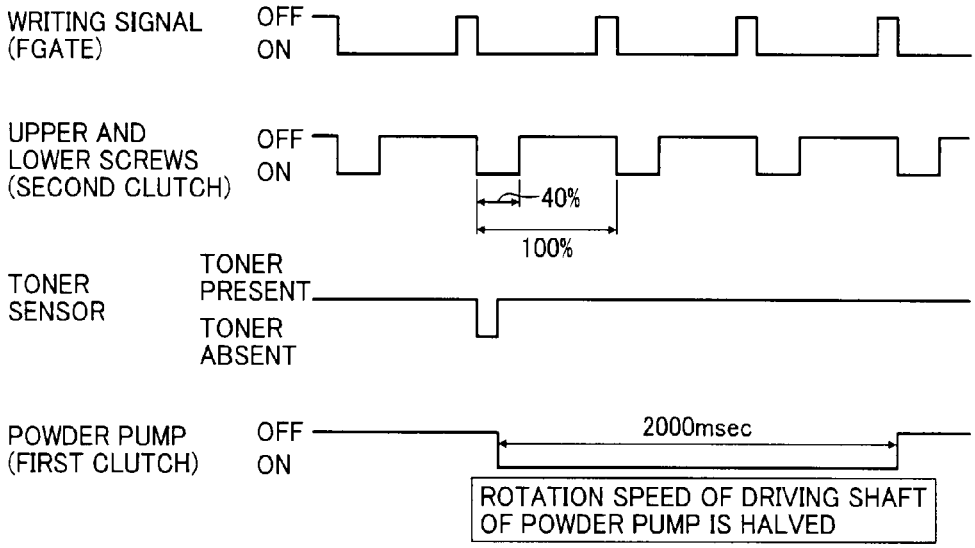
FIG. 16 is a timing chart illustrating another example of the toner supply control of the present invention when the toner supply duty is 40%.

Another example of the toner supply control operation to decrease the toner feeding efficiency is that as illustrated in FIG. 16, the rotation speed of the driving shaft of the powder pump P is decreased so as to be half that in the case illustrated in FIG. 14. Specifically, in order to decrease the toner feeding efficiency, the toner supply controller performs a toner supply control operation in which the flow rate of the toner fed from the toner container 80 to the sub-hopper 61 is decreased. By performing this control operation, the same effect as that in the case illustrated in FIGS. 11, 12 and 15 can be produced.

When it is necessary for the toner supply duty to be greater than 40% (i.e., when images with a higher image area ratio are repeatedly formed), it is preferable to use a combination of the first-mentioned toner supply control operation in which the period of one toner feeding operation of feeding the toner from the toner container 80 to the sub-hopper 61 is shortened and the second-mentioned toner supply control operation in which the flow rate of the toner fed from the toner container to the sub-hopper is decreased.

As mentioned above, when the amount of toner to be fed to the developing device is larger than the predetermined amount (i.e., the toner supply duty is greater than 20%), the toner supply controller performs a toner supply control operation in which the toner feeding efficiency is decreased. In this regard, whether or not the amount of toner to be fed to the developing device is larger than the predetermined amount can be determined from the variation in the output of the toner sensor 69. However, in this method the pump driving conditions are controlled after confirming that the toner supply duty exceeds the predetermined value, and therefore the method is not entirely satisfactory. It is preferable that the toner supply duty be estimated from the image area ratio of an electrostatic latent image on the photoreceptor drum 40, which is determined by an image area ratio calculator provided in the image forming apparatus, and when the estimated toner supply duty is greater than the predetermined value, the above-mentioned toner supply control operation is performed.

Figure 25:
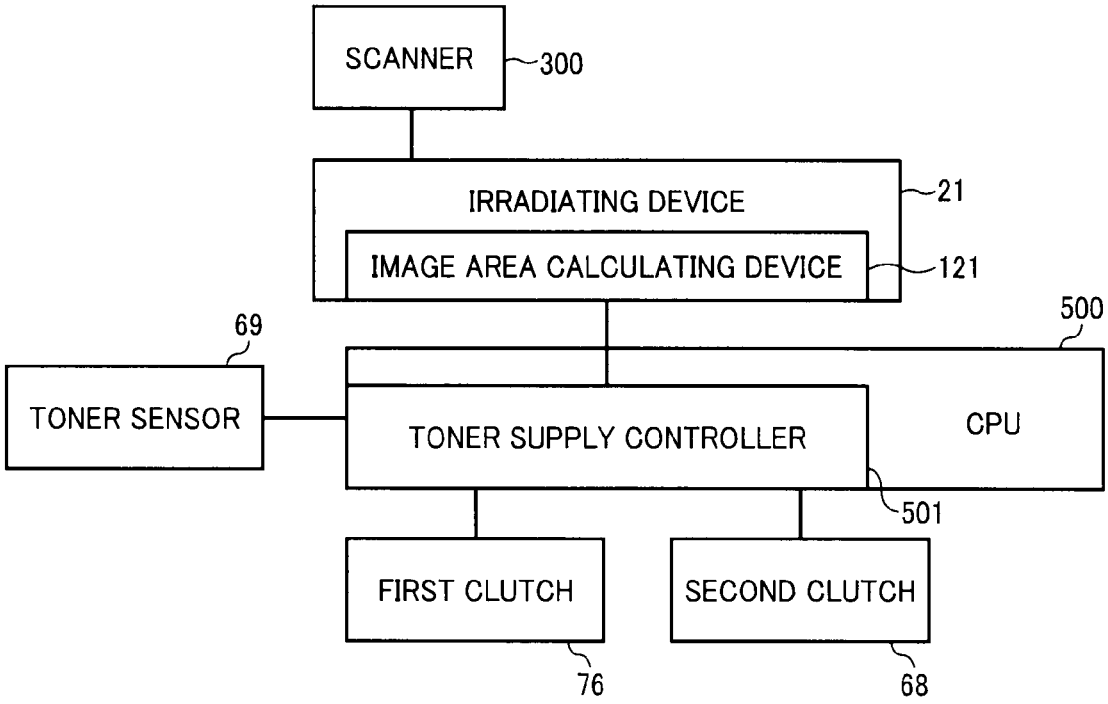
FIG. 25 is a block diagram illustrating a toner supply controller and an image area calculating device for use in the toner supplying device and the image forming apparatus of the present invention.

FIG. 25 is a block diagram illustrating a toner supply controller and an image area calculating device for use in the toner supplying device and the image forming apparatus of the present invention.

Referring to FIG. 25, image information of an original image read by the scanner 300 is sent to the irradiating device 21 to be converted to image data. An image area calculating device 121 calculates the image area ratio of the original image from the image data. The information on the image area ratio of the original image is input to a CPU 500 of the image forming apparatus. In addition, information on presence/absence of the toner in the upper chamber 62 is sent by the toner sensor 69 to the CPU 500. A toner supply controller 501 of the CPU 500 controls the first clutch 76 and the second clutch 68 according to the information to perform a toner supply control operation.

Another example of the toner supply control operation for use in the toner supplying device of the present invention will be described.

Figure 17:
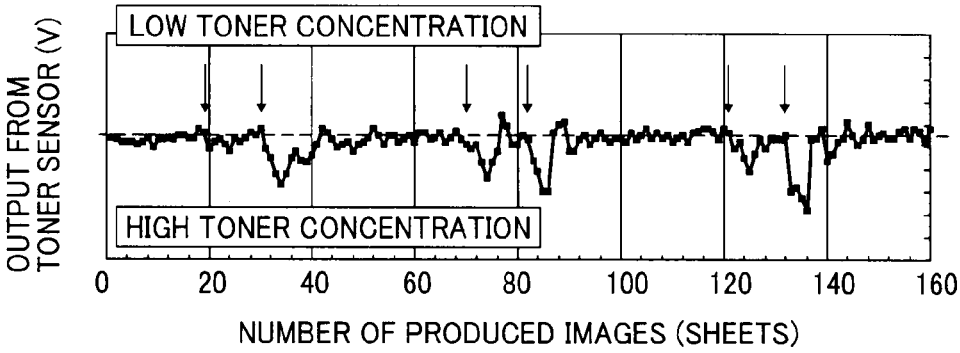
FIG. 17 is a graph illustrating a relation between the number of produced images and the output from a toner sensor when the toner influx is caused.

FIG. 17 illustrates another example of variation of the output from the toner sensor when the toner supply duty is 40% and the toner influx is caused. Specifically, in FIG. 17, the toner is fed from the toner container 80 to the sub-hopper 61 by the powder pump P at times indicated by arrows. It can be understood from FIG. 17 that the output from the toner sensor largely decreases (i.e., the concentration of the toner in the developer increases) right after the toner is supplied. This is because the toner influx is caused.

Figure 18:
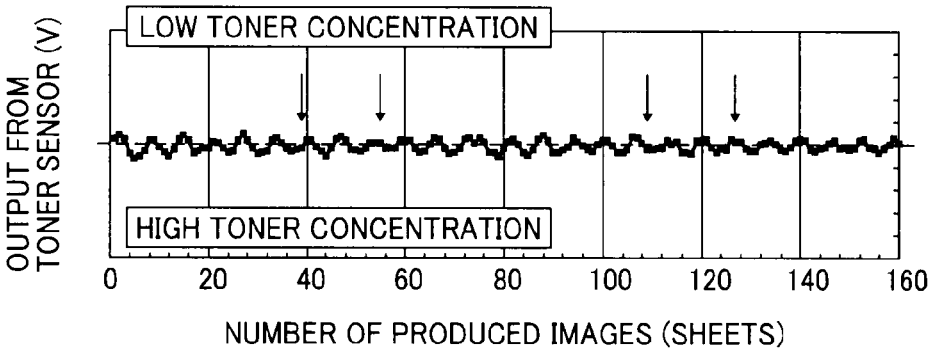
FIG. 18 is a graph illustrating a relation between the number of produced images and the output from a toner sensor when the toner influx is not caused.

FIG. 18 illustrates another example of variation of the output from the toner sensor when the toner supply duty is less than 40%. Although the toner is fed from the toner container 80 to the sub-hopper 61 by the powder pump P at times indicated by arrows, the output from the sensor does not increase even after the toner is supplied. Therefore, the toner influx is not caused. Thus, occurrence of the toner influx can be prevented even when the operation of feeding the toner from the sub-hopper 61 to the developing device 60, which is performed by engaging the second clutch 68 to rotate the upper and lower screws 84, 85 and 86, is not perfectly stopped.

Figure 19:
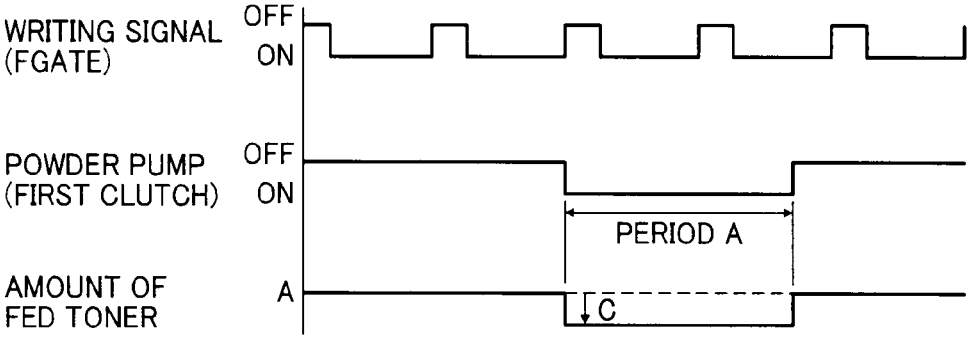
FIG. 19 is a timing chart illustrating another example of the toner supply control of the present invention.
Figure 20:
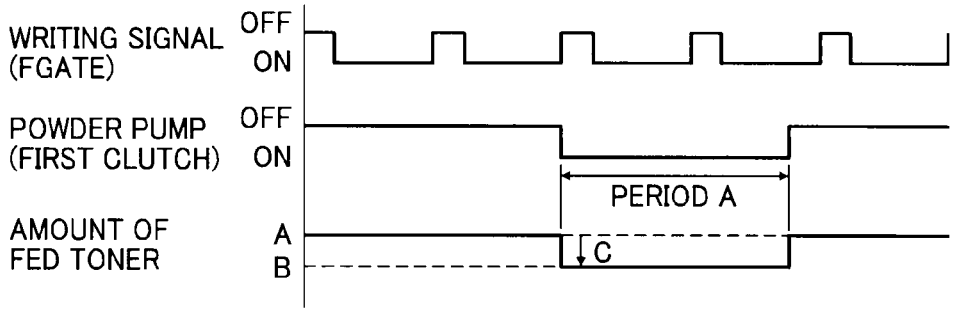
FIG. 20 is a timing chart illustrating another example of the toner supply control of the present invention.

In this case, as illustrated in FIG. 19 the toner supply controller performs a toner supply control operation in which the amount of the toner fed from the sub-hopper 61 to the developing device 60 per unit of time is decreased in an amount of D (i.e., decrease from a normal toner feeding amount S to an amount M) in a period A in which the powder pump P is operated. In this regard, it is preferable to control the amount of the toner fed from the sub-hopper 61 to the developing device 60 per unit of time so as to be not greater than the maximum amount M as illustrated in FIG. 20. By performing this control operation, occurrence of the toner influx can be prevented.

Figure 21:
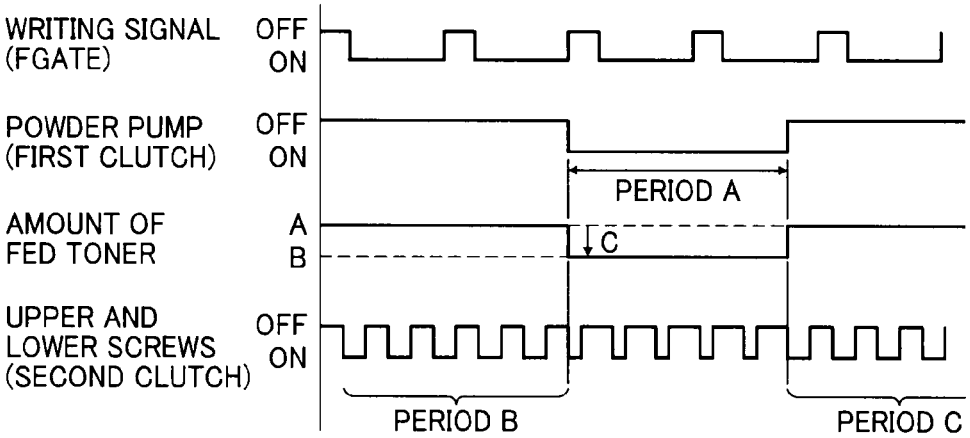
FIG. 21 is a timing chart illustrating another example of the toner supply control of the present invention.
Figure 22:
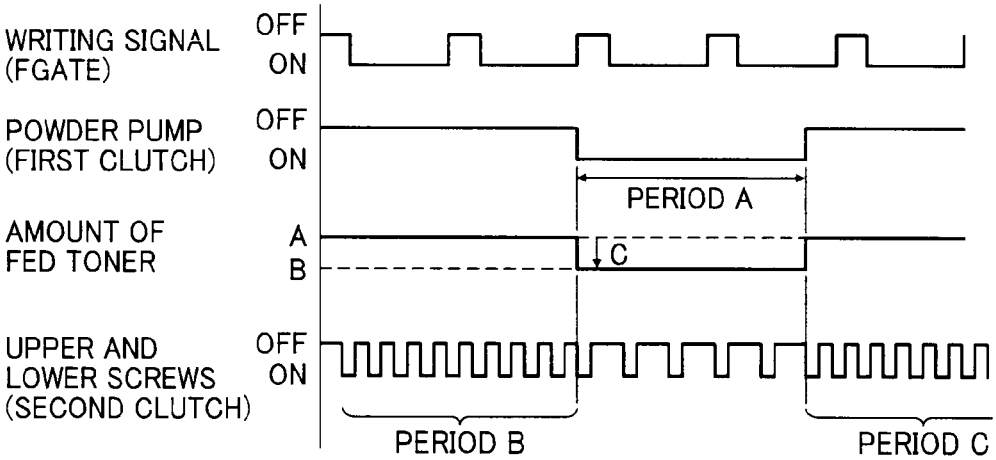
FIG. 22 is a timing chart illustrating another example of the toner supply control of the present invention.

One example of the method for decreasing the amount of the toner fed from the sub-hopper 61 to the developing device 60 per unit of time in the period A is illustrated in FIG. 21. Specifically, when the clutch engaging time (i.e., t1 in FIG. 21) during which the second clutch 68 is engaged is decreased in the period A so as to be shorter than the clutch engaging time (i.e., t2) in the periods B and C during which the powder pump P is not operated. Alternatively, as illustrated in FIG. 22, another method can be used in which the number of times of engagement of the second clutch 68 per unit of time is decreased in the period A so as to be smaller than that in the periods B and C during which the powder pump P is not operated. In this case, the clutch engaging time in the period A is the same as that in the periods B and C.

Figure 23:
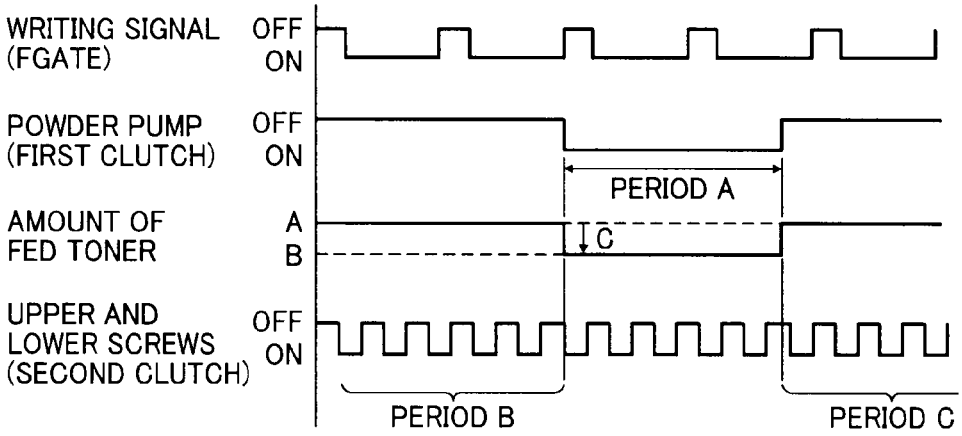
FIG. 23 is a timing chart illustrating another example of the toner supply control of the present invention.

Another example of the method for decreasing the amount of the toner fed from the sub-hopper 61 to the developing device 60 per unit of time in the period A during which the powder pump P is operated is to decrease the rotation speed of the driving shaft 79 connected with the second clutch 68 so as to be lower than the rotation speed of the driving shaft in the periods B and C during which the powder pump P is not operated, so that the flow rate of the toner fed from the sub-hopper 61 to the developing device 60 in the period A is lower than in the periods B and C. In this case, the engaging time (t1) of the second clutch is the same as that in the periods A, B and C as illustrated in FIG. 23.

Figure 24:
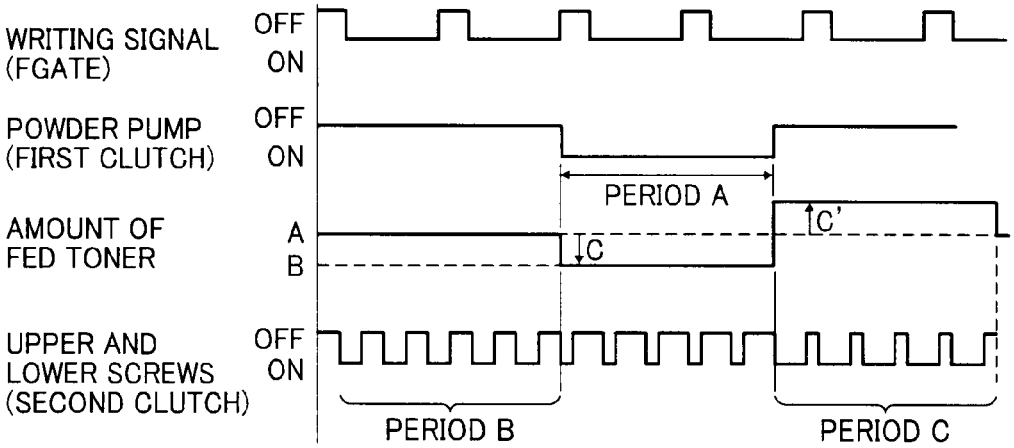
FIG. 24 is a timing chart illustrating another example of the toner supply control of the present invention.

When the above-mentioned toner supply control operation in which the amount of the toner fed from the sub-hopper 61 to the developing device 60 is decreased in the period A during which the powder pump P is operate, the toner supply controller preferably performs a control operation in which when the powder pump P is not operated, i.e., in the periods B and C, the amount of the toner fed from the sub-hopper to the developing device is increased to compensate for the decrease in the amount of the toner fed from the sub-hopper to the developing device in the period A in which the powder pump is operated. For example, as illustrated in FIG. 24, when the amount of the toner fed from the sub-hopper 61 to the developing device 60 is decreased in an amount of D in the period A, the amount of the toner fed from the sub-hopper to the developing device is increased in an amount of D' in the period C by increasing the pulse width from t2 to t3 to compensate for the decrease in the amount of the toner fed from the sub-hopper to the developing device in the period A. By performing such a control operation, a sufficient amount of toner can be supplied to the developing device.

Thus, the image forming apparatus equipped with the toner supplying device of the present invention can produce high quality images without forming abnormal images caused by the toner influx even when images with a high image area ratio are repeatedly produced.

Hereinbefore, the image forming apparatus equipped with the toner supplying device of the present invention is described. However, the present invention is not limited to the above-described examples. For example, the toner sensor 69 is not limited to a vibration-type toner sensor, and another toner sensor such as a transparent-type toner sensor can also be used therefor. In addition, the sub-hopper 61 is not limited to a sub-hopper having an upper chamber and a lower chamber, and another hopper such as a hopper having only one chamber can also be used therefor.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application Nos. 2009-254564 and 2009-260856, filed on Nov. 6, 2009, and Nov. 16, 2009, respectively, the entire contents of which are herein incorporated by reference.

What is claimed is:

1. A toner supplying device for supplying a toner from a toner container to a developing device, comprising:

a secondary toner container disposed between the toner container and the developing device to temporarily store the toner;

a first feeding member configured to perform a first toner feeding operation of feeding the toner from the toner container to the secondary toner container on demand;

a second feeding member configured to perform a second toner feeding operation of feeding the toner from the secondary toner container to the developing device on demand; and a toner supply controller configured to control the first and second toner feeding operations so that an amount of the toner in the secondary toner container is greater than a predetermined amount, and perform one of a first control operation and a second control operation, wherein, in the first control operation, when the first toner feeding operation is performed, an amount of the toner fed in the second toner feeding operation per unit of time is relatively decreased to a maximum toner feeding amount greater than 0 compared to a case of a normal toner feeding amount in which the first toner feeding operation is not performed, and wherein, in the second control operation, when the amount of the toner fed in the second toner feeding operation is greater than a predetermined amount, an amount of the toner fed in the first toner feeding operation per unit of time is relatively decreased compared to a case in which the amount of the toner fed in the second toner feeding operation is not greater than the predetermined amount.

2. The toner supplying device according to claim 1, wherein the amount of the toner fed in the second toner feeding operation per unit of time has an upper limit as the toner supply controller performs the first control operation.

3. The toner supplying device according to claim 1, wherein the amount of the toner fed in the second toner feeding operation per unit of time is decreased by shortening a period of the second toner feeding operation so as to be shorter than that in a case in which the first toner feeding operation is not performed as the toner supply controller performs the first control operation.

4. The toner supplying device according to claim 1, wherein the amount of the toner fed in the second toner feeding operation per unit of time is decreased by decreasing a flow rate of the toner per unit of time in the second toner feeding operation so as to be lower than that in a case in which the first toner feeding operation is not performed as the toner supply controller performs the first control operation.

5. The toner supplying device according to claim 1, wherein, after performing the first control operation, the toner supply controller performs another control operation in which, when the first toner feeding operation is not performed, the amount of the toner fed in the second toner feeding operation per unit of time is increased to compensate for decrease in the amount of the toner fed in the last second toner feeding operation in the first control operation as the toner supply controller performs the first control operation.

6. The toner supplying device according to claim 1, wherein the amount of the toner fed in the first toner feeding operation per unit of time is decreased by shortening a period of the first toner feeding operation so as to be shorter than that in a case in which the amount of the toner fed in the second toner feeding operation is not greater than the predetermined amount, while pausing before a next first toner feeding operation as the toner supply controller performs the second control operation.

7. The toner supplying device according to claim 1, wherein the amount of the toner fed in the first toner feeding operation per unit of time is decreased by decreasing a flow rate of the toner per unit of time in the first toner feeding operation so as to be lower than that in a case in which the amount of the toner fed in the second toner feeding operation is not greater than the predetermined amount as the toner supply controller performs the second control operation.

8. The toner supplying device according to claim 1, wherein the amount of the toner fed in the first toner feeding operation per unit of time is decreased by shortening a period of the first toner feeding operation so as to be shorter than that in a case in which the amount of the toner fed in the second toner feeding operation is not greater than the predetermined amount, while pausing before a next first toner feeding operation, and decreasing a flow rate of the toner per unit of time in the first toner feeding operation so as to be lower than that in a case in which the amount of the toner fed in the second toner feeding operation is not greater than the predetermined amount as the toner supply controller performs the second control operation.

9. An image forming apparatus comprising:

an image bearing member configured to bear an electrostatic latent image thereon;

a developing device configured to develop the electrostatic latent image with a developer including a toner;

a toner container configured to contain the toner; and the toner supplying device according to claim 1, configured to supply the toner from the toner container to the developing device.

10. The image forming apparatus according to claim 9, further comprising an image area calculating device configured to calculate an image area ratio of the electrostatic latent image on the image bearing member, wherein the toner supplying device determines whether or not the amount of the toner fed in the second toner feeding operation is greater than the predetermined amount based on the calculated image area ratio.

11. The toner supplying device according to claim 1, wherein the toner container is separated from the secondary toner container via a toner feeding tube having a first end thereof connected to a toner suction opening of the toner secondary container and a second end thereof connected to a nozzle that couples with the toner container.

12. The toner supplying device according to claim 1, wherein toner is transferred to the secondary toner container via a powder pump including a screw rotor, a stator in which the screw rotor rotates, and a holder that covers the stator and the screw rotor.

13. The toner supplying device according to claim 12, wherein the screw rotor is connected with a clutch that drives the pump.

14. The toner supplying device according to claim 1, wherein the second toner feeding operation causes the toner to drop from the secondary toner container directly into the developing device via a toner supply opening.

15. The toner supplying device according to claim 1, wherein the secondary toner container includes a pump that draws toner from the toner container into the secondary toner container, and a sub-hopper into which the toner drawn by the pump falls.

16. The toner supplying device according to claim 15, wherein the sub-hopper includes first and second screws that direct the toner drawn from the pump to drop into the developing device.

* * * * *